US005793393A

United States Patent [19]

Coven

[11] Patent Number: 5,793,393

[45] Date of Patent: Aug. 11, 1998

[54] DUAL CONSTRICTION INKLET NOZZLE FEED CHANNEL

[75] Inventor: Patrick J. Coven, Albany, Oreg.

[73] Assignee: Hewlett-Packard Company, Palo Alto, Calif.

[21] Appl. No.: 692,209

[22] Filed: Aug. 5, 1996

[51] Int. Cl.[6] ..... B41J 2/05

[52] U.S. Cl. ..... 347/65; 347/94

[58] Field of Search ..... 347/65, 63, 56, 347/54, 20, 1, 94

[56] References Cited

U.S. PATENT DOCUMENTS

| | | | |
|---|---|---|---|
| 4,882,595 | 11/1989 | Trueba et al. | 346/140 R |
| 5,274,400 | 12/1993 | Johnson et al. | 346/140 R |
| 5,278,584 | 1/1994 | Keefe et al. | 346/140 R |
| 5,291,226 | 3/1994 | Schantz et al. | 346/140 R |
| 5,308,442 | 5/1994 | Taub et al. | 156/644 |
| 5,387,314 | 2/1995 | Baughman et al. | 156/643 |
| 5,519,423 | 5/1996 | Moritz, III et al. | 347/65 |

*Primary Examiner*—Benjamin R. Fuller
*Assistant Examiner*—Juanita Stephens

[57] ABSTRACT

An inkjet printhead includes multiple printing elements grouped in sets about an ink refill channel. Each printing element includes a firing chamber and resistive element in communication with the refill channel via an ink feed channel. The feed channels are of differing length resulting in resistive elements being at staggered distances from the refill channel. To balance fluidic dynamics among printing elements a first constriction and second constriction occur along the length of the feed channels. The first constriction is adjacent the firing chamber and acts as a diffuser during firing. The second constriction is adjacent the refill channel and slows the refill process for feed channels of shorter length. For longer feed channels the second constriction is wider. For shorter feed channels the second constriction is narrower. Differing widths of the second constriction slow down refill by differing amounts to balance fluid dynamics among the printing elements.

16 Claims, 4 Drawing Sheets

DUAL CONSTRICTION INKLET NOZZLE FEED CHANNEL

BACKGROUND OF THE INVENTION

This invention relates generally to inkjet printhead structures, and more particularly, to active inkjet printhead structures for introducing ink into firing chambers from which ink is ejected onto print media.

An inkjet printhead includes multiple firing chambers for ejecting ink onto a print media to form characters, symbols and/or graphics. Typically, the ink is stored in a reservoir and passively loaded into respective firing chambers via an ink refill channel and respective ink feed channels. Capillary action moves the ink from the reservoir through the refill channel and ink feed channels into the respective firing chambers. Firing chambers typically occur as cavities in a barrier layer. Associated with each firing chamber is a firing resistor and a nozzle. The firing resistors are formed on a common substrate. The barrier layer is attached to the substrate. By activating a firing resistor, an expanding vapor bubble forms which forces ink from the firing chamber into the corresponding nozzle and out a nozzle orifice. A nozzle plate adjacent to the barrier layer defines the nozzle orifices. The geometry of the firing chamber and ink feed channel defines how quickly a corresponding firing chamber is refilled after nozzle firing.

Typical passive loading of a nozzle chamber includes the rapid flow of ink into the chamber after firing. The ink flow action is characterized as a repeating flow and ebb process in which ink flows into the chamber, then back-flows slightly. Channel geometry defines passive damping qualities which limit the ink in-flow and determine a steady-state chamber height. The flow and ebb cycle is passively damped until a steady state chamber level is maintained. The time to achieve a steady state is referred to as "setting time". The setting time limits the maximum repetition rate at which printhead nozzles can operate.

It is desired to achieve ejection of ink drops having known repeatable volume and shape. Firing a nozzle too soon after a previous firing can result in either an "overshoot" or an "undershoot" condition. Overshoot is when the volume of ink in the firing chamber is above a steady state volume. Firing at such time causes a relatively larger droplet to be ejected. Undershoot is when the volume of ink in the firing chamber is below the steady state volume. Firing at such time causes a relatively smaller droplet to be ejected.

Current thermal inkjet printheads use a resistor multiplex pattern which allows the resistors to be fired at different times. Typically, the resistors are offset spatially to compensate for such timing. A common ink refill channel is etched through the silicon substrate. Typically, a vertical edge, or shelve, is formed along each edge of the ink refill channel. The ink feed channels are in fluid communication with the ink refill channel via the shelf. The respective resistors are staggered relative to the shelf, thereby creating different path lengths from the refill channel to the respective firing chambers. The differing path lengths result in different resistance to ink flow, and thus, vary the time it takes to refill each firing chamber. The different path lengths also vary the damping action at the firing chamber.

One challenge when implementing a multiplex pattern of adjacent resistors and firing chambers is to avoid cross-talk between neighboring firing chambers. Cross-talk, as used herein, refers to the condition during which fluid dynamics for one feed channel/firing chamber affects the fluid dynamics for another feed channel/firing chamber.

SUMMARY OF THE INVENTION

According to the invention, first and second constrictions are formed in the feed channels of multiple printing elements. The printing elements have firing chambers and firing resistors within the chambers at staggered distances away from a common ink refill channel. The feed channel for a printing element provides communication of ink between the refill channel and the printing element's firing chamber. The feed channel's first constriction occurs toward a firing chamber end of the feed channel. The second constriction occurs toward the entrance of the feed channel away from the firing chamber. A region having a width wider than each constriction occurs between the two constrictions. The first constriction serves as a diffusion barrier resisting back flow of ink (or bubble blow back) into the feed channel during nozzle firing. The wider region between the constrictions adds inertial dampening for further resisting bubble blow back. The second constriction serves to slow down refill speed of the printing element.

According to one aspect of the invention, the feed channel width at the second constriction differs among printing elements having a different distance between its firing resistor and the refill channel. The second constriction adds more surface area to shorter length feed channels so as to increase viscous drag and slow down refilling. In effect the second constriction causes the feed channel to behave in some aspects like a narrower channel. An advantage of the two constriction approach over a narrower feed channel, however, is that while bubble blow back might still occur for the narrow feed channel, bubble blow back affects are avoided using the two constriction feed channel geometry. The dual constrictions achieve a desired slowing of the refill rate to varying degree for printing elements having different lengths, while also improving resistance to bubble blow back.

According to another aspect of the invention, the second width is implemented as a function of the distance from refill channel to firing resistor. Preferably, the second width is so implemented in a manner which balances the ink refill process for printing elements having such differing lengths from firing resistor to refill channel. In some embodiments, the refill time is the same for each printing element regardless of the length from firing resistor to refill channel. In a preferred embodiment, the width at the second constriction is narrowest for a printing element having the shortest length from refill channel to firing resistor. The second constriction width increases for printing elements of longer length. The second constriction is absent for printing elements having the longest lengths from firing resistor to refill channel. In such embodiment, second constriction width increases from a narrowest width to a feed channel width for printing elements of increasing length from refill channel to firing resistor.

According to another aspect of the invention, the entrance to each feed channel occurs at the same distance from the ink refill channel, rather than at a staggered distance. An advantage of implementing a common distance is that fluid dynamic cross-talk among adjacent feed channels is avoided. Firing, filling and other fluid dynamics at one printing element do not significantly impact the same at adjacent printing elements.

According to a preferred embodiment an inkjet printhead for ejecting ink droplets onto a print medium, includes a plurality of printing elements formed in one or more layers and an ink refill channel defined by an edge. The plurality of printing elements are grouped into sets, with component resistive elements of a given set staggered at different distances from the edge. Each one of a multiple of said plurality of printing elements includes a resistive element, nozzle, firing chamber and feed channel. The resistive element heats ink supplied from a reservoir to generate the ink droplets. The ink droplets are ejected through the nozzle. The firing chamber is enclosed on three sides by a first layer and has a base supporting the resistive element. The nozzle is aligned with the firing chamber. The ink feed channel supplies ink to the firing chamber through an entrance on a fourth side of the firing chamber. The feed channel has a first pair of opposed projections adjacent such fourth side. The projections are separated by a first width formed in walls to the feed channel defining a first constriction. Several feed channels also have a second pair of opposed projections separated by a second width formed in walls of the feed channel defining a second constriction. The feed channel has a third width wider than the first width and second width in a region between the first constriction and second constriction.

In some embodiments the edge further defines a shelf adjacent to the refill channel. The shelf provides communication between the ink refill channel and the ink feed channels. Each feed channel has an opening at a common distance removed from the refill channel along the shelf. The opening is formed by a barrier layer and serves to avoid fluid dynamics cross talk between adjacent printing elements.

For any first printing element and second printing element in a given set of printing elements in which the second width for the first printing element is wider than the second width for the second printing element, the resistive element for the first printing element is located farther from the refill channel than the resistive element for the second printing element.

Conversely, in some embodiments for any first printing element in which the resistive element is farther away from the refill channel than is the resistive element of any second printing element, the second width of the feed channel associated with the first resistive element is wider than the second width of the feed channel associated with the second resistive element.

These and other aspects and advantages of the invention will be better understood by reference to the following detailed description taken in conjunction with the accompanying drawings.

DESCRIPTION OF SPECIFIC EMBODIMENTS

Figure 1:
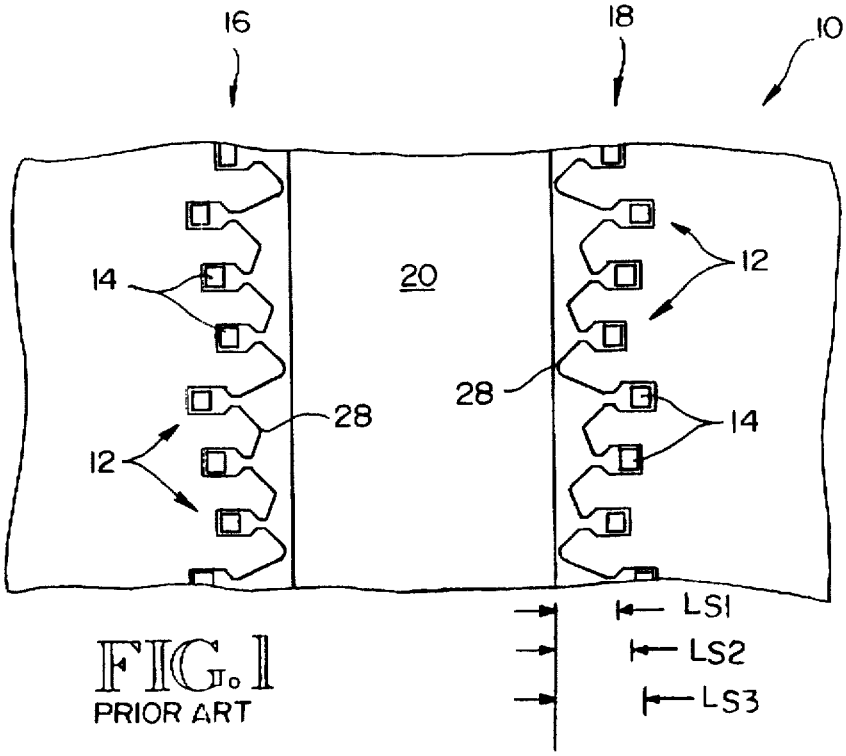
FIG. 1 PRIOR ART
FIG. 1 is a plan view of a portion of a conventional inkjet printhead in which the printhead nozzle plate is not shown.

FIG. 1 shows a portion of a conventional inkjet printhead 10, including a plurality of printing elements 12. Each printing element 12 includes a firing resistor 14. The printing elements are generally arranged in two parallel rows 16, 18 on either side of an ink refill channel 20. Ink flows from a reservoir (not shown) into the ink refill channel 20, then into respective printing elements 12. Firing chambers 26 (see FIG. 2) including the corresponding firing resistors 14 are at a staggered distance from the refill channel 20. Path lengths $L_{s1}$, $L_{s2}$, $L_{s3}$ from the refill channel 20 to the centers of the firing resistor 14 are shown for three printing elements 12.

Figure 2:
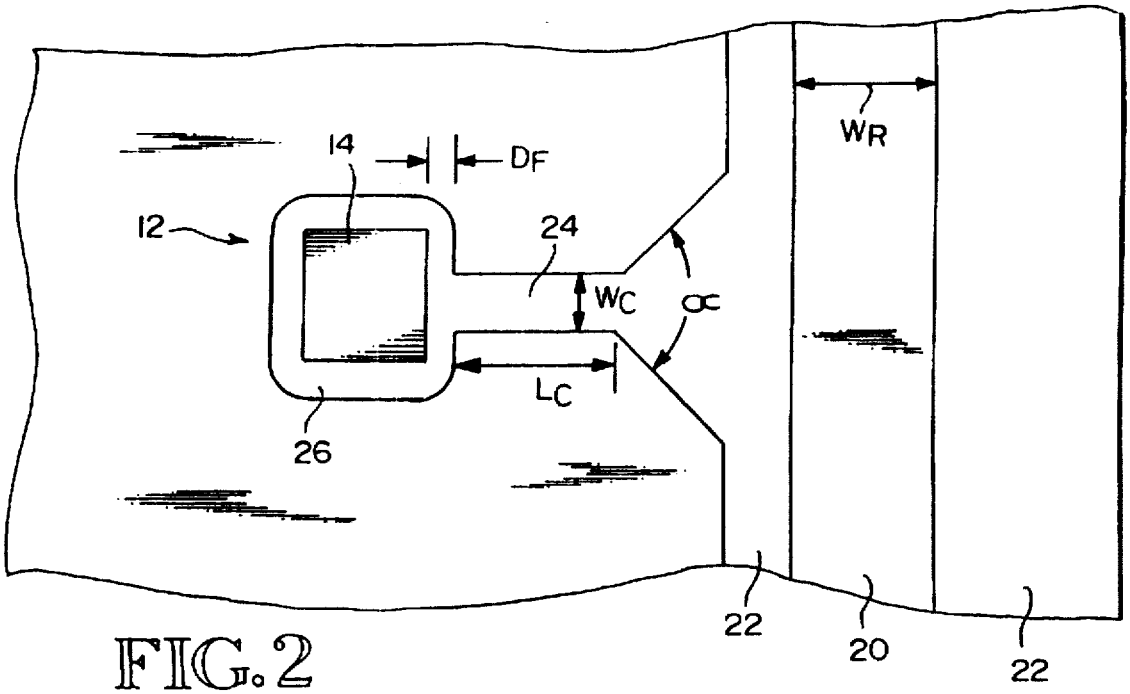
FIG. 2 PRIOR ART
FIG. 2 is a plan view of a conventional printing element and ink refill channel for the printhead of FIG. 1.

FIG. 2 shows a plan view of a conventional printing element 12 in more detail. The ink refill channel 20 has a width $W_R$. A shelf 22 is formed at each edge of the refill channel 20. Respective ink feed channels 24 formed on the shelf 22 provide ink communication between respective firing chambers 26 and the ink refill channel 20. A given feed channel 24 has a length $L_c$ and a width $W_c$. An interval distance $D_F$ occurs within the firing chamber 26 from a far end of the feed channel 24 to a proximal edge of the firing resistor 14.

Figure 3:
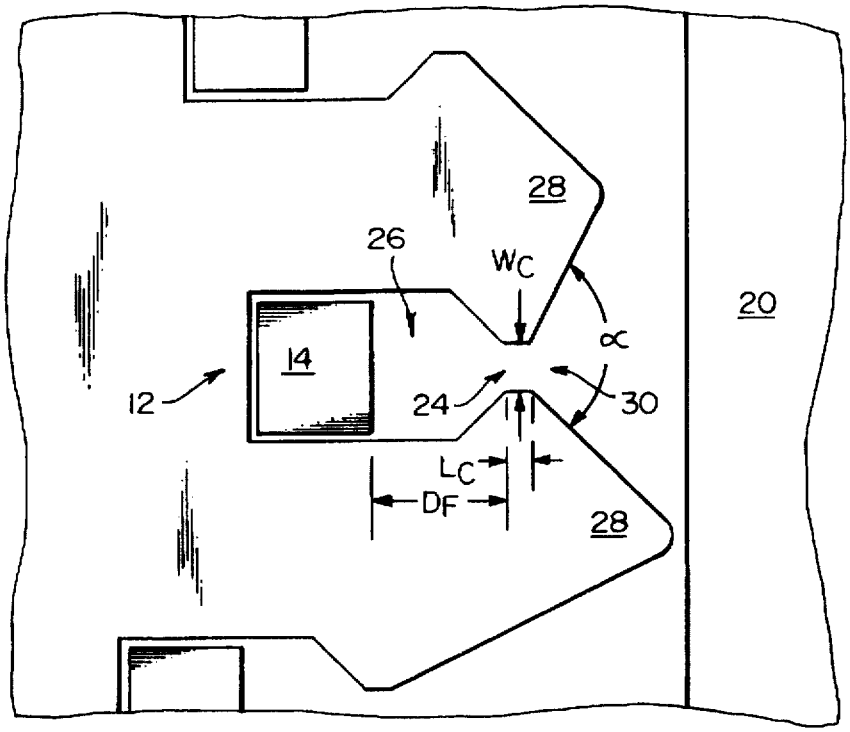
FIG. 3 PRIOR ART
FIG. 3 is a plan view of another conventional printing element and ink refill channel for the printhead of FIG. 1.

FIG. 3 shows a plan view of another conventional printing element 12 in detail having different feed channel 24 and firing chamber 26 dimensions. Lead-in lobes 28 occur on each side of the entrance to the feed channel 24. An included angle $\propto$ is defined by lobes 28 at the entrance 30 to the ink feed channel 24. The lobes 28 serve to prevent bubbles from residing in the ink within the ink refill channel 20. Specifically, the lobes 28 guide any such bubbles into a firing chamber 26, where they are purged during firing.

Printing Element

Figure 4:
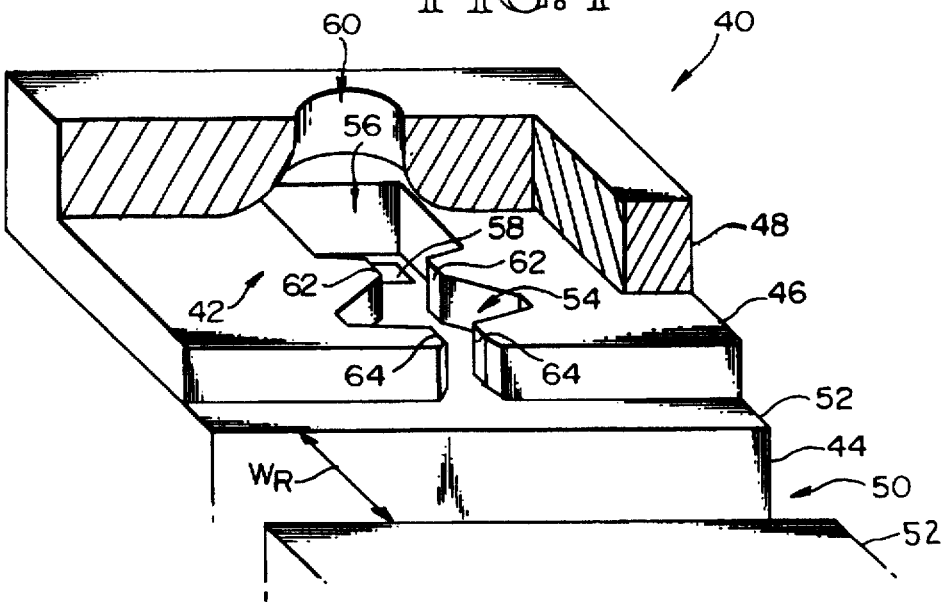
FIG. 4 is a cutaway view of a portion of an inkjet printhead according to an embodiment of this invention.

FIG. 4 shows a printer element 42 portion of a printhead 40 according to an embodiment of this invention. The printhead 40 includes a substrate 44, a barrier layer 46, and a nozzle plate 48. The printer element 42 is formed in the three layers 44, 46, 48. The barrier layer 46 is deposited onto the substrate 44 and is offset from a refill channel 50. In one embodiment the ink refill channel 50 is etched through a portion of the substrate 44 (e.g., for a center feed construction). In another embodiment ink refill channels 50 are formed adjacent to two sides of the substrate 44 (e.g., for edge feed construction). The portion of the substrate 44 adjacent to the refill channel(s) 50 and barrier layer 46 define a shelf 52. For center feed construction the shelf 52 is formed on each side of the refill channel 50.

Etched within the barrier layer 46 is an ink feed channel 54 and a firing chamber 56. A firing resistor 58 is situated within the firing chamber 56 and formed on a base (e.g. substrate 44). The nozzle plate 48 includes an opening, or nozzle 60, aligned with the firing chamber 56. The nozzle plate 48 also forms a border covering the feed channel 54, shelf 52 and refill channel 50. In practice the nozzle plate 48 includes a plurality of orifices, each one operatively associated with a firing chamber 56 to define an inkjet nozzle 60 from which an ink droplet is ejected. In alternative embodiments, the barrier layer 46 and nozzle plate 48 are formed by a common layer.

In operation ink fills the refill channel 50, feed channel 54 and firing chamber 56. The ink forms a meniscus bulging into the nozzle 60. The firing resistor 58 is connected by an electrically conductive trace (not shown) to a current source. The current source is under the control of a processing unit (not shown), and sends current pulses to select firing resistors 58. An activated firing resistor 58 causes an expanding vapor bubble to form in the firing chamber 56 forcing such ink out through the nozzle 60. The result is a droplet of ink ejected onto a media sheet at a specific location. Such droplet, as appearing on the media sheet, is referred to as a dot. Conventionally, characters, symbols and graphics are formed on a media sheet at a resolution of 300 dots per inch or 600 dots per inch. Higher resolutions also are possible.

Figure 5:
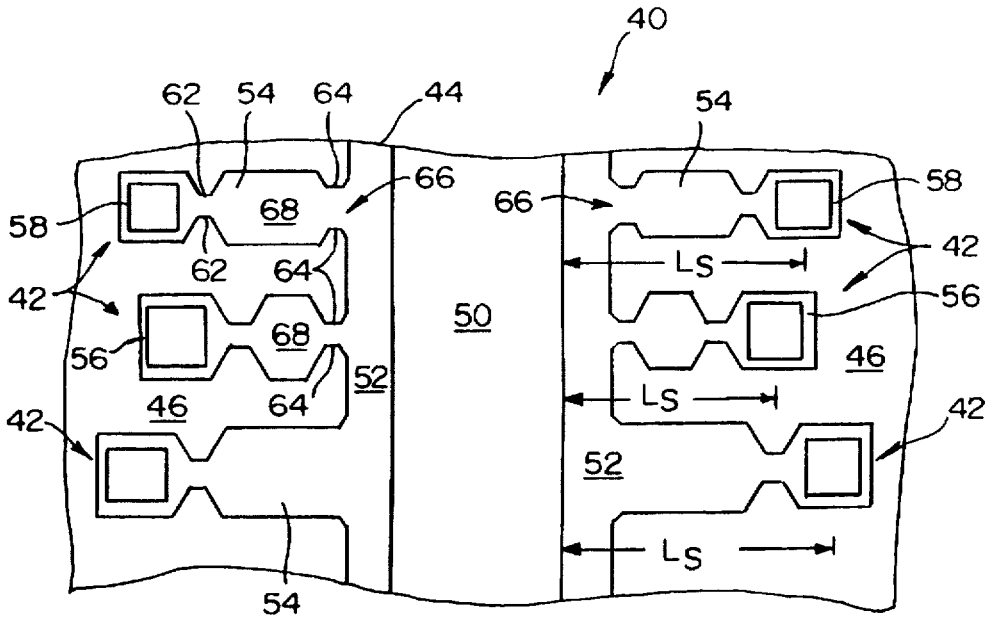
FIG. 5 is a plan view of a portion of an inkjet printhead according to an embodiment of this invention (in which the printhead nozzle plate is not shown)

FIG. 5 shows a partial multiplex pattern of printing elements 42 according to a center feed construction, absent the nozzle plate 48. The centers of the firing resistors 58 are defined at a staggered distance, $L_s$, from the refill channel 50. In a preferred embodiment, a stagger pattern of approximately 20 different lengths $L_s$ is formed and repeated over sets of approximately 20 corresponding printing elements 42. In various embodiments a pattern repeats for sets of 3 or more printing elements 42. For all printing elements 42 a first localized constriction 62 is formed at one end of the feed channel 54 adjacent to the firing chamber 56. Such constriction 62 serves as a diffusion barrier resisting back flow of ink (or bubble blow back) into the feed channel 54 during nozzle firing. The feed channel 54 widens at a region 68 adjacent to the first constriction.

For most printing elements 42 a second localized constriction 64 is formed toward an entrance end 66 of the feed channel 54. The purpose of the second constriction 64 is to slow down refill speed for the shorter length ($L_s$) feed channels 54. Specifically, the second constriction 64 adds more surface area to the feed channel 54 so as to increase viscous drag. The second constriction 64 decreases the equivalent hydraulic diameter of the feed channel 54, increasing the channel's hydraulic resistance. In effect the second constriction causes the feed channel 54 to behave like a narrower channel. The area between the two constrictions 62, 64 defines the widened feed channel portion 68. Feed channel portion 68 has a width, $W_{c3}$. The purpose of the wider portion 68 is to add inertial dampening for resisting bubble blow back. More specifically, if the varied widths of the feed channel 54 were instead replaced with a narrower channel to slow the refill rate, bubble blow back might still occur. For a narrow channel the bubble could expand too far into the channel 54 reducing volume of an ejected droplet. The dual constrictions achieve the desired slowing of the refill rate to varying degree for printing elements 42 having different length $L_s$ dimensions, while also improving resistance to bubble blow back.

Typically, the feed channel 54 width, $W_{c1}$, at the first constriction is the same for all printing elements 42. The feed channel width, $W_{c2}$, at the second constriction varies depending on the distance, $L_s$, between the firing resistor 58 center and the refill channel 50. The farther the firing resistor 58 from the refill channel 50, the wider the second constriction 64. For a printing element having the farthest distance of length, $L_s$, there is no second constriction (see FIG. 8). In a preferred embodiment the width $W_{c2}$ at the second constriction 64 varies from one width to a widest width at which there is no second constriction 64, as the length $L_s$ goes from a shortest distance to a longest distance away from the refill channel 50.

Following is an equation for pressure drop in a feed channel which can be used to determine a desired width $W_{c2}$ for a given printing element 42:

$$\Delta P = \frac{128\,\mu Q}{\pi} \int_0^L \frac{1}{D_{eq}(z)}\,dz$$

where

P=the pressure drop through a given feed channel

Q=volumetric flow rate;

μ=viscosity;

$D_{eq}$=equivalent hydraulic diameter of feed channel 54; and $L=L_s$=length between refill channel 50 and firing chamber 56.

The pressure drop through a given feed channel is constant for each feed channel. At the refill channel entrance the pressure is at the refill channel pressure. At the refill channel exit the pressure is at the nozzle pressure. The goal is to match the volumetric flow rate, Q, for each feed channel regardless of the feed channel length, $L_s$; To do so, the equivalent hydraulic diameter, $D_{eq}$, is increased as the length, $L_s$, is increased. Thus, one solves the above equation for $D_{eq}$. With the channel height being constant (e.g., the barrier layer height) the width $W_{c2}$ is directly related to the calculated equivalent hydraulic diameter, $D_{eq}$.

Following are values for $L_s$ and $W_{c2}$ for an exemplary multiplex pattern of 20 different lengths $L_s$:

| $L_s$ (μm) | $W_{c2}$ (μm) |
|---|---|
| 107 | 24.00 |
| 109 | 26.00 |
| 110.75 | 27.75 |
| 112.75 | 29.75 |
| 114.5 | 31.50 |
| 116.5 | 33.50 |
| 118.25 | 35.25 |
| 120.25 | 37.25 |
| 122.25 | 39.25 |
| 124 | 41.00 |
| 126 | 43.00 |
| 127.75 | 44.75 |
| 129.75 | 46.75 |
| 131.75 | 48.75 |
| 133.5 | 50.50 |
| 135.5 | 52.50 |
| 137.25 | 54.25 |
| 139.25 | 56.25 |
| 141 | 58.00 |
| 143 | 60.00 |

The second constrictions 64 serve to increase fluidic resistance to compensate for the different stagger lengths $L_s$ of respective printing elements 42. By doing so the printing elements perform in a more balanced manner. Specifically, printing elements 42 with short lengths $L_s$ are given enough fluidic resistance to experience refill speeds as slow as printing elements with longer lengths. Because fluidic resistance influences both refill rate and bubble blow back during firing, other ejection parameters such as droplet volume, velocity, and damping are also more closely balanced among printing elements having differing length $L_s$ dimensions.

According to one aspect of the invention, the entrance 66 for each feed channel 54 occurs at a common distance, $D_s$, from the refill channel 50. Such a common distance contrasts to the prior art approach shown in FIGS. 1 and 3 where lobes 28 are formed are varying distance from the refill channel 50. An advantage of the common distance approach is that cross-talk between adjacent feed channels 54 is minimized. For some prior art embodiments the varying distances at which the lobes 28 are formed cause the fluid dynamics of one firing chamber 26/feed channel 24 to impact the fluid dynamics of an adjacent firing chamber 26/feed channel 24. According to the common distance approach of this invention, firing, filling and other fluid dynamics at one firing chamber 56/feed channel 54 do not significantly impact the same at adjacent firing chambers 56/feed channels 54.

Figure 6:
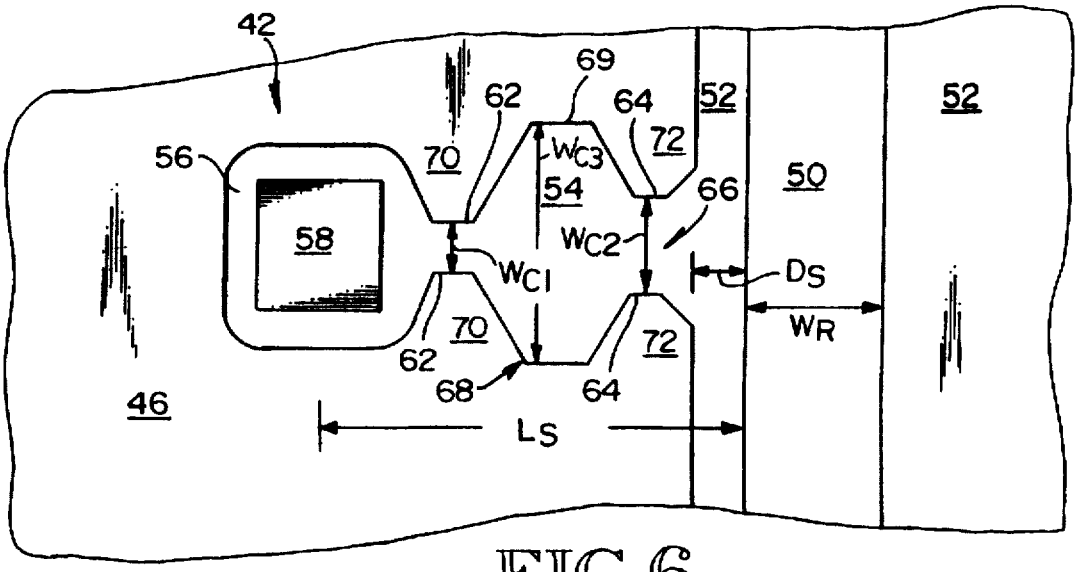
FIG. 6 is a plan view of a printing element of the printhead of FIG. 5.
Figure 7:
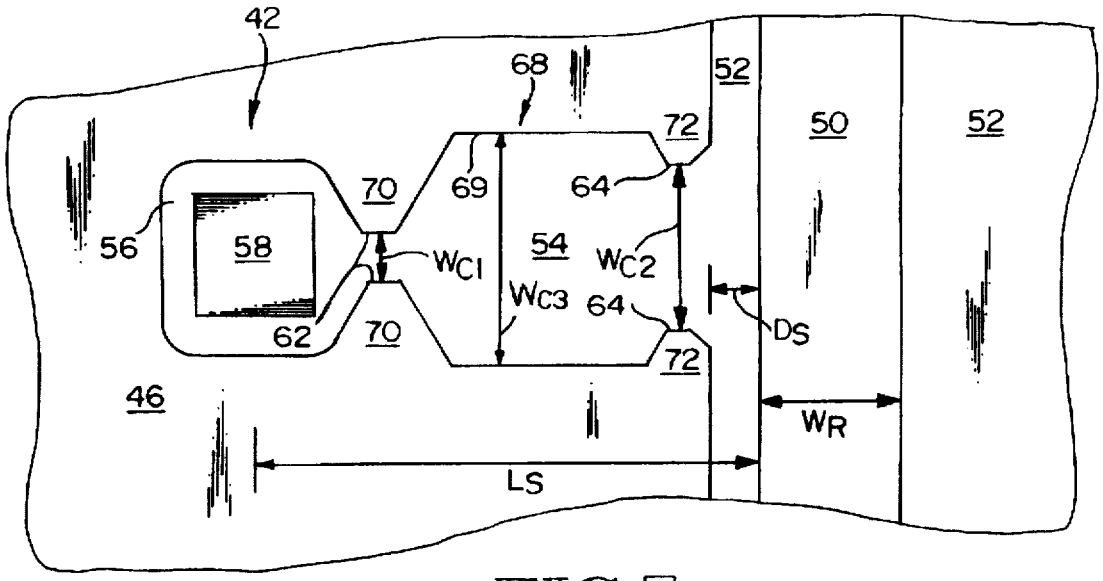
FIG. 7 is a plan view of another printing element of the printhead of FIG. 5.
Figure 8:
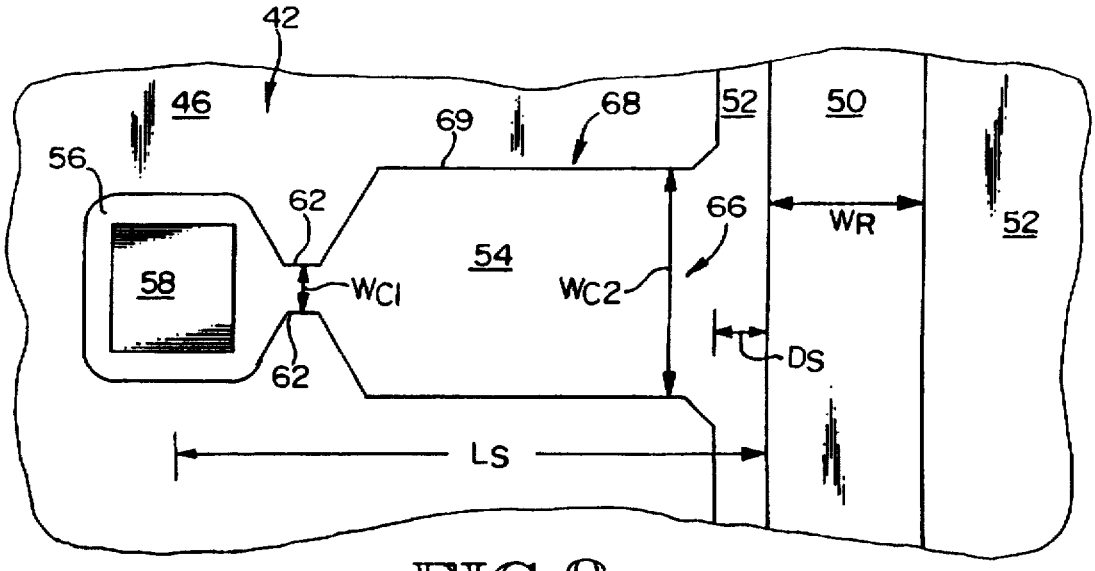
FIG. 8 is a plan view of yet another printing element of the printhead of FIG. 5.

FIGS. 6–8 show printing elements 42 having the firing resistor 58 centers differing distances $L_s$ from the refill channel 50. In a preferred embodiment the resistors 58, firing chambers 56, first constrictions 62 and wide portions 68 of each channel 54 are the same for each printing element 42 regardless of the length $L_s$. Exemplary dimensions for the resistors 58 are 35 μm on each side with a spacing of 8 μm to the barrier 46 on each of three sides. The first constriction 62 defines a channel width, $W_{c1}$, equal to 25 μm. The barrier 46 defines a pair of 45 degree angles on a fourth side of the resistor 58 to define protrusions 70 for the constriction 62. The 45 degree angled barrier occurs along a longitudinal increment of the feed channel (channel increment as measured perpendicular to refill channel) equal to 13 μm. The first constriction 62 extends for a longitudinal length of 5 μm. The barrier 46 also defines a pair of 60 degree angles to open to the wider portion 68 of the feed channel 54. The 60 degree angled barrier extends for a longitudinal increment of the feed channel 54 equal to 10 μm. A straight edge portion 69 of the barrier in region 68 is of varying length. Another 60 degree angle then is defined by the barrier 46 to form protrusions 72 defining the second constriction 64. The second constriction 64 extends for a longitudinal length of another 5 μm. The walls of the feed channel are chamfered at the feed channel opening 66 at a 45 degree angle forming a hypotenuse length corresponding to a lateral and longitudinal distance of 3.5 μm. The width of the second constriction $W_{c2}$ varies depending on length $L_s$. For the length $L_s$=107 μm, $W_{c2}$=24 μm. The length of section 69 and the longitudinal increment of the 60 degree angled barrier portion for the protrusions 72 are of a length which provides the desired second constriction width, $W_{c2}$. FIG. 7 shows a printing element 42 in which $L_s$ is longer than for the printing element of FIG. 6. For example, a FIG. 7 printing element 42 representing a length $L_s$=127.75 μm has a wider width at the second constriction (e.g., $W_{c2}$=44.75 μm). The extra length 127.75−107=20.75 μm is achieved in part by extending section 69 to increase the length of region 68. FIG. 8 shows an embodiment for the longest length $L_s$ for a given set. The length 69 extends region 68 all the way to the feed channel opening 66 to define the widest second constriction (actually the lack of a second constriction), where $W_{c2}$=60 μm. Although specific lengths and angular dimensions are given for an exemplary embodiment, the dimensions and specific geometry patterns may vary.

Although in the preferred embodiment the second constriction width $W_{c2}$ varies with variation of the length $L_s$ for given printing elements 42, in an alternative embodiment, the number of different second widths $W_{c2}$ for a given set of printing elements 42 is less than the number of printing elements 42 in such set. For example, although there may be 20 different lengths $L_s$ for a set of printing elements 42, there are fewer than 20 different feed channel second widths $W_{c2}$ in the alternate embodiment. In one embodiment there are as few as five different widths $W_{c2}$ for a set of 20 printing elements 42. Note that the printing elements having the largest width $W_{c2}$ have the longest lengths $L_s$. Correspondingly, the printing elements having the next largest width $W_{c2}$ have the next longest lengths $L_s$, and so on with the printing elements having the narrowest widths $W_{c2}$ having the shortest lengths $L_s$.

In another alternative embodiment, the number of different lengths $L_s$ for a given set of printing elements 42 is less than the number of printing elements 42 in such set. For example, although there may be 20 different second widths $W_{c2}$ for a set of printing elements 42, there are fewer than 20 different lengths Ls. In one embodiment there are as few as five different lengths $L_s$ for a set of 20 printing elements 42. Note that the printing elements having the largest width $W_{c2}$ have the longest lengths $L_s$. Correspondingly, the printing elements having the next largest width $W_{c2}$ have the next longest lengths $L_s$, and so on with the printing elements having the narrowest widths $W_{c2}$ have the shortest lengths $L_s$.

Although preferred embodiments have been described and illustrated, various alternatives, modifications and equivalents may be used. Therefore, the foregoing description should not be taken as limiting the scope of the inventions which are defined by the appended claims.

What is claimed is:

1. An inkjet printhead for ejecting ink droplets onto a print medium, said printhead comprising:

a plurality of resistive elements for heating ink to generate said ink droplets;

a plurality of nozzles through which said ink droplets are ejected, with one nozzle associated with one resistive element;

a plurality of firing chambers with one nozzle and one resistive element associated with one firing chamber, each one firing chamber enclosed on three sides by a barrier, each one firing chamber having a base supporting said one associated resistive element, with said one associated nozzle above said one associated resistive element;

a plurality of ink feed channels with one feed channel associated with one firing chamber, each one feed channel for supplying ink to said one associated firing chamber through an entrance on a fourth side of said associated firing chamber, wherein for each said one feed channel a first pair of opposed projections separated by a first width are formed in walls to said one feed channel to cause a first constriction; and an ink refill channel operatively associated with said plurality of ink feed channels, the ink refill channel defined by an edge;

wherein for a multiple of feed channels of the plurality of ink feed channels, a second pair of opposed projections separated by a second width are formed in the walls of each of said multiple feed channels to cause respective second constrictions, and for each of said multiple feed channels, a third width wider than said first width and said second width occurs in a region between said first constriction and said second constriction.

2. The printhead of claim 1, in which the edge further defines a shelf adjacent to the ink refill channel, the shelf providing communication between the ink refill channel and said plurality of ink feed channels, and wherein each of the plurality of feed channels has an opening at a common distance removed from the refill channel along the shelf.

3. The printhead of claim 1, wherein for any first resistive element and second resistive element among the plurality of resistive elements in which the second width of the feed channel associated with the first resistive element is wider than the second width of the feed channel associated with the second resistive element, said first resistive element is located farther from the refill channel than the second resistive element.

4. The printhead of claim 1, wherein for any first resistive element of the plurality of resistive elements which is farther away from the refill channel than any second resistive element of the plurality of resistive elements, the second width of the feed channel associated with the first resistive element is wider than the second width of the feed channel associated with the second resistive element.

5. The printhead of claim 1, wherein for any given feed channel the second width is implemented as a function of length between the associated resistive element and the refill channel.

6. The printhead of claim 5, wherein each second constriction of the plurality of ink feed channels slows associated firing chamber refill time based upon said second width, causing said refill time between firings to be a common time for each of said plurality of firing chambers.

7. The printhead of claim 1, further comprising means for avoiding fluid dynamics cross talk between adjacent firing chambers and associated feed channels.

8. The printhead of claim 7, in which the avoiding means comprises a barrier defining an opening for each of the plurality of feed channels at a common distance from the refill channel along a shelf defined by said edge.

9. An inkjet printhead for ejecting ink droplets onto a print medium, said printhead comprising:

a plurality of printer elements formed in one or more layers of said printhead;

an ink refill channel defined by an edge of said one or more layers;

wherein each one of a multiple of said plurality of print elements comprises:

(a) a resistive element for heating ink to generate said ink droplets;

(b) a nozzle through which said ink droplets are ejected;

(c) a firing chamber enclosed on three sides by a first layer and having a base supporting said resistive element, the nozzle aligned with the firing chamber;

(d) an ink feed channel for supplying ink to said firing chamber through an entrance on a fourth side of said firing chamber, wherein said feed channel has a first pair of opposed projections separated by a first width formed in walls to said feed channel to cause a first constriction and said feed channel has a second pair of opposed projections separated by a second width formed in walls to said feed channel to cause a second constriction, and wherein said feed channel has a third width wider than said first width and said second width in a region between said first constriction and said second constriction; and wherein the ink refill channel is operatively associated with said ink feed channel.

10. The printhead of claim 9, in which the edge further defines a shelf adjacent to the refill channel, the shelf providing communication between the ink refill channel and the ink feed channels, and wherein each feed channel has an opening at a common distance removed from the refill channel along the shelf.

11. The printhead of claim 9, wherein for any first printer element and second printer element among the plurality of printer elements in which the second width for the first printer element is wider than the second width for the second printer element, the resistive element for said first printer element is located farther from the refill channel than the resistive element for the second printer element.

12. The printhead of claim 9, wherein for any first printer element of the plurality of printer elements in which the resistive element is farther away from the refill channel than is the resistive element of any second printer element of the plurality of printer elements, the second width of the feed channel associated with the first resistive element is wider than the second width of the feed channel associated with the second resistive element.

13. The printhead of claim 9, wherein second width is implemented as a function of length between the resistive element and the refill channel.

14. The printhead of claim 9, wherein the second constriction for each printer element slows firing chamber refill time based upon said second width, causing refill time between firings to be a common time for each of said plurality of printer elements.

15. The printhead of claim 9, further comprising means for avoiding fluid dynamics cross talk between adjacent printer elements.

16. The printhead of claim 15, in which the avoiding means comprises a barrier layer defining an opening for each one feed channel of adjacent printer elements, said opening being defined at a common distance from the refill channel along a shelf defined by said edge.

* * * * *